US006736137B1

(12) United States Patent
Resnick et al.

(10) Patent No.: US 6,736,137 B1
(45) Date of Patent: May 18, 2004

(54) PROTECTIVE HOODED RESPIRATOR WITH ORAL-NASAL CUP BREATHING INTERFACE

(75) Inventors: Todd A. Resnick, Stuart, FL (US); Richard L. Stein, Lake Forest, CA (US); John Kern, Brea, CA (US); Anthony Osborne, Rancho Cucamonga, CA (US)

(73) Assignee: TMR-A, LLC, Stuart, FL (US)

( * ) Notice: Subject to any disclaimer, the term of this patent is extended or adjusted under 35 U.S.C. 154(b) by 0 days.

(21) Appl. No.: 10/248,908

(22) Filed: Feb. 28, 2003

(51) Int. Cl.[7] ..... A62B 7/10

(52) U.S. Cl. ..... 128/201.25; 128/202.15; 128/205.27; 128/206.15; 128/206.24

(58) Field of Search ..... 128/200.24, 201.22–202.11, 128/202.13, 202.15, 203.29, 205.25, 206.12–207.18, 201.19, 205.27–205.29

(56) References Cited

U.S. PATENT DOCUMENTS

| | | | | | |
|---|---|---|---|---|---|
| 3,633,575 | A | | 1/1972 | Brumfield | |
| 4,467,795 | A | | 8/1984 | Eckstein | |
| 4,473,072 | A | | 9/1984 | Walther | |
| 4,771,771 | A | | 9/1988 | Walther | |
| 4,793,342 | A | * | 12/1988 | Haber et al. | 128/202.27 |
| 4,811,728 | A | | 3/1989 | Von Kopp | |
| 4,831,664 | A | * | 5/1989 | Suda | 2/457 |
| 4,883,052 | A | | 11/1989 | Weiss et al. | |
| 4,886,056 | A | * | 12/1989 | Simpson | 128/201.25 |
| 5,040,530 | A | | 8/1991 | Bauer et al. | |
| 5,181,507 | A | * | 1/1993 | Michel et al. | 128/201.25 |
| 5,206,958 | A | * | 5/1993 | Widenback | 2/457 |
| H136 | H | | 10/1994 | Grove et al. | |
| 5,687,713 | A | | 11/1997 | Bahr et al. | |
| 6,016,802 | A | | 1/2000 | Jackson | |
| 6,123,077 | A | | 9/2000 | Bostock et al. | |
| 6,158,429 | A | | 12/2000 | Gardner et al. | |
| 6,173,712 | B1 | | 1/2001 | Brunson | |
| 6,176,239 | B1 | | 1/2001 | Grove et al. | |
| 6,302,103 | B1 | | 10/2001 | Resnick | |
| 6,340,024 | B1 | * | 1/2002 | Brookman et al. | 128/201.25 |
| 6,371,116 | B1 | | 4/2002 | Resnick | |
| 6,450,165 | B1 | | 9/2002 | Silver et al. | |
| 6,460,538 | B1 | | 10/2002 | Kemp | |
| 6,484,722 | B2 | | 11/2002 | Bostock et al. | |
| 6,543,450 | B1 | * | 4/2003 | Flynn | 128/206.19 |
| 2002/0023651 | A1 | | 2/2002 | Japuntich et al. | |
| 2002/0157668 | A1 | | 10/2002 | Bardel | |
| 2003/0005934 | A1 | | 1/2003 | Japuntich et al. | |

* cited by examiner

*Primary Examiner*—Glenn K. Dawson
(74) *Attorney, Agent, or Firm*—Anton J. Hopen; Smith & Hopen, P.A.

(57) ABSTRACT

The present invention is a protective hooded respirator optimized for both high protection against nuclear, chemical and/or biological agents as well as having a design configuration enabling it to be stored as a highly compact unit. The hood includes a flexible oral-nasal breathing interface interior to the hood. A filter-housing exterior to the hood is fluidly coupled by a single conduit that intakes filtered air during inhalation and exhaled air during exhalation. When in storage, the flexible oral-nasal is folded into a substantially flat configuration.

15 Claims, 11 Drawing Sheets

PROTECTIVE HOODED RESPIRATOR WITH ORAL-NASAL CUP BREATHING INTERFACE

BACKGROUND OF INVENTION

1. Field of Invention

This invention relates to a hooded respirator providing both high protection against toxic agents and compact storage.

2. Background of Invention

Utilization of an oral-nasal cup in combination with a neck-sealing hood is desirable for its protection factor and comfort to the wearer. However, when fashioning an apparatus that must be highly compacted, the presence of the oral-nasal cup poses a challenge because of its size and traditional configuration. Oral-nasal cups typically are fluidly coupled to one or more filters that purify incoming inhaled air. An important consideration in the design of a respiratory device is breathing resistance. A check valve, separate from the filter, discharges exhaled air. Preferably, the check valve is positioned in close proximity to the wearer's face. This permits the exhaled air to take the shortest possible route before being discharged from the apparatus. In turn, this reduces the resistance encountered by the wearer during exhalation and thus lessens fatigue. Accordingly, oral-nasal cups typically have at least two separate fluid paths, one for exhalation and another for inhalation. The fluid paths each have a separate opening though the barrier that protects the wearer's face.

A significant problem in the prior art is that of size. To be effective, the hooded respirator must be transported by military and civilian agencies and often donned with short notice. Accordingly, keeping the storage size small is an important factor in the deployment of a protective respiratory device. If the device is too large or cumbersome to transport, it will inhibit the individual's ability to perform his or her task. Alternatively, the large size of the hooded respirator may even forgo the individual's ability to carry potentially life-saving protection.

A possible solution is to fold the normally bulky oral-nasal cup during storage so that it takes up less room. However, in doing so, numerous problems arise. First, oral-nasal cups are biased against the face of the wearer to establish a substantially airtight seal. Therefore, the oral-nasal cup must be rigid enough not to collapse against the face under such pressure. However, a rigid oral-nasal cup cannot be effectively folded for storage. Soft, yielding material may be used for the oral-nasal cup so that folding is possible. However, when applied against the face, insufficient rigidity is provided by the material and the cup collapses against the face.

A second problem that arises in the compact storage of oral-nasal cups is that of anchor points. Oral-nasal cups normally have at least two conduits, one for inhalation and another for exhalation. If the device requires drink capability, then a third conduit may be present. Furthermore, many oral-nasal cup designs utilize two filters. Therefore, there may be four anchor points forming mechanical couplings on the oral-nasal cup. With multiple anchor points, it is not possible to effectively fold the oral-nasal cup into a compact shape. What is needed is a single anchor point to the oral-nasal cup to handle inhalation, exhalation, and drinking requirements. However, such a design is counter-intuitive to the teachings of the prior art.

A third problem that arises in the compact storage of oral-nasal cups is that of cup distortion. As the interface between the cup and the face of the wearer is critical to maintaining a high protection factor, creasing of the oral-nasal cup as a result of folding may cause unfiltered air to be inhaled. Accordingly, there is substantial resistance by those skilled in the relevant art to fold the oral-nasal cup.

SUMMARY OF INVENTION

The present invention is a hooded respirator optimized for both high protection against nuclear, chemical and/or biological agents as well as having a design configuration enabling it to be stored as a highly compact unit. The hood includes a flexible, folding oral-nasal cup breathing interface interior to the hood. A mechanical filter-housing exterior to the hood is fluidly coupled by a single conduit that intakes filtered air during inhalation and exhaled air during exhalation. While flexible filters, integral to the hood, are known in the art, mechanical filters (filtration media encased in a substantially rigid enclosure) are considered more reliable and have greater capabilities.

When in storage, the flexible oral-nasal cup is folded into a substantially flat configuration. What makes this folding possible is that there is only a single conduit between the interior and exterior of the hood thereby providing a pathway for both inhalation and exhalation. The oral-nasal is secured by a single anchor point to the rest of the device. A drink tube is threaded through the single conduit. The drink tube permits the drinking of hot and cold liquids including liquid medication. Preferably, the diameter of the tube is sufficient to permit a drinking rate of at least 200 milliliters per minute.

The filter housing has a front side having at least one or more apertures for receiving unfiltered air. A rear side of the filter housing has the single conduit fluidly coupled to the breathing interface. The exhalation check valve is also positioned on the rear side of the filter housing. The filter housing interior holds particulate filtration media and carbon combination. Preferably, the particulate filter media and carbon combination provide protection against vapor, aerosol, and particulate matter threat agents. More specifically, the particulate filter media and carbon combination should protect again field concentrations of all military agents as defined in FM 3–9, all biological agents, radioactive fallout particles, and certain toxic industrial chemicals. Preferably, inhalation resistance through the filter media and into the oral-nasal should not exceed 30 mm of H2O when tested using a flow rate of 85 liters per minute.

An interior chamber coincident to the rear side of the filter housing is defined by a plurality of support ribs radiating from the single conduit. The support ribs serve at least three functions: (1) to define the interior chamber wherein inhaled and exhaled air is passed; (2) to direct inhaled air towards the single conduit from the filtration media; and (3) to direct exhaled air towards the exhalation check valve from the single conduit.

During inhalation, the support ribs direct inhaled, filtered air towards the single conduit to which they radiate. However, the support ribs must also direct exhaled air from the conduit to the exhalation check valve during exhalation. At least one or more passages are formed in the support ribs between the single conduit and the exhalation check valve to permit a flow of exhaled air. Therefore, during inhalation, the majority of airflow comprises a straight path through the filtration media and into the interior chamber. The flow then takes a ninety-degree turn and flows along the radiating support ribs to the single conduit where it takes another ninety-degree turn into the oral-nasal cup. During exhalation, airflow out of the oral-nasal cup through the single conduit takes a ninety-degree turn and flows down the interior chamber towards the exhalation check valve.

To minimize resistance, optimally, airflow strikes a check valve at a perpendicular angle. Positioning the exhalation check valve to accommodate this angle would necessitate the exhalation check valve being relocated to the bottom side of the filter housing, distal from the single conduit. However, in doing so, the package size of the filter housing would be unacceptably increased. The present inventors discovered that when exhaled air strikes the exhalation check valve, even a shallow angle, exhalation resistance is unexpectedly and dramatically reduced over that observed with a check valve angled parallel to air flow. Accordingly, in a preferred embodiment of the invention, the exhalation check valve in the interior chamber is canted towards the single conduit in a range between zero and ninety-degrees. Balancing both compact size and reduce breathing resistance, the angle is optimally eight-degrees. Exhalation resistance from the oral-nasal cup, through the single conduit and out the exhalation check valve should not exceed 20 mm H2O when tested using a flow rate of 85 liters per minute.

To enable the angled position of the exhalation check valve, the rear side of the filter housing may be arcuate. The heights of the support ribs vary in the interior chamber to offset the curve of the rear side of the filter housing. At least one exhalation conduit downstream from the exhalation check valve is provided, preferably with external baffles to inhibit the backflow of unfiltered air through the exhalation conduit. As noted above, airflow that strikes a check valve at a perpendicular angle generally provides the least amount of exhalation resistance. However, the present invention employs an angled exhalation check valve. Therefore, the portion of the exhalation check valve that tends to unseal first is that portion distal from the single conduit. Accordingly, it is preferred that the at least one exhalation conduit be positioned proximate to the portion of the exhalation check valve distal from the single conduit. A check valve cover sealingly covers the exhalation check valve and external baffles. The external baffles are defined by walls projecting from the rear side of the filter housing. The height of the walls varying in complementary relation to the arcuate slope of the rear side of the filter housing whereby the external baffle walls distal to the single conduit are higher than the external baffle walls proximate to the single conduit. Accordingly, a greater void exists between the check valve and the check valve cover distal to the single conduit. This greater void reduces air flow resistance along the optimum fluid path.

To form an acceptable seal about the face, the oral-nasal cup must be biased against the face of the wearer. Accordingly, a preferred embodiment of the invention includes at least one or more tension straps that encircle the head of the wearer. The tension straps are secured to the filter housing and adapted to bias the oral-nasal cup against the face of the wearer to form a substantially airtight seal. While the oral-nasal cup may be formed of various materials having differing elastomeric properties, the present invention anticipates a oral-nasal cup that can be folded over on itself during compact storage. This necessitates the utilization of a oral-nasal cup that is relatively soft and yielding. However, as the tension straps exert pressure on the filter housing, the oral-nasal cup may collapse. Accordingly, a preferred embodiment of the invention includes a pressure distribution bar secured to the filter housing and biased across a portion of the oral-nasal cup whereby force applied by the tension straps at the filter housing is distributed across the oral-nasal cup.

BRIEF DESCRIPTION OF DRAWINGS

The respirator hood having the oral-nasal cup may be configured in a novel manner. A hood adapted to enclose the head of a wearer is provided, the hood having an interior and an exterior. A neck opening in the hood is provided, the neck opening adapted to seal about the neck of the wearer. A filter housing is provided, the filter housing adapted to filter inhaled air and exhaust exhaled air, the filter housing secured to the exterior of the hood. A flexible, resilient oral-nasal cup is secured to the interior of the hood, the cup having an upper portion covering the nose of the wearer when engaged and a contiguous lower portion covering the mouth of the wearer when engaged, an interior cavity wherein respiration occurs, an opening adapted to sealingly engage the wearer's face and an exterior. An inwardly disposed lip about the perimeter of the cup is provided and the filter housing is fluidly coupled to the oral-nasal cup interior cavity through an aperture in the hood. The lip of the upper portion is pulled outward whereby it is fully extended. The upper portion and extended lip of the cup are folded to lay flat against the lower portion of the cup across a fold line defined by the cup opening. Finally, the cup is then pulled through the neck opening.

For a fuller understanding of the nature and objects of the invention, reference should be made to the following detailed description, taken in connection with the accompanying drawings, in which.

DETAILED DESCRIPTION

Figure 1:
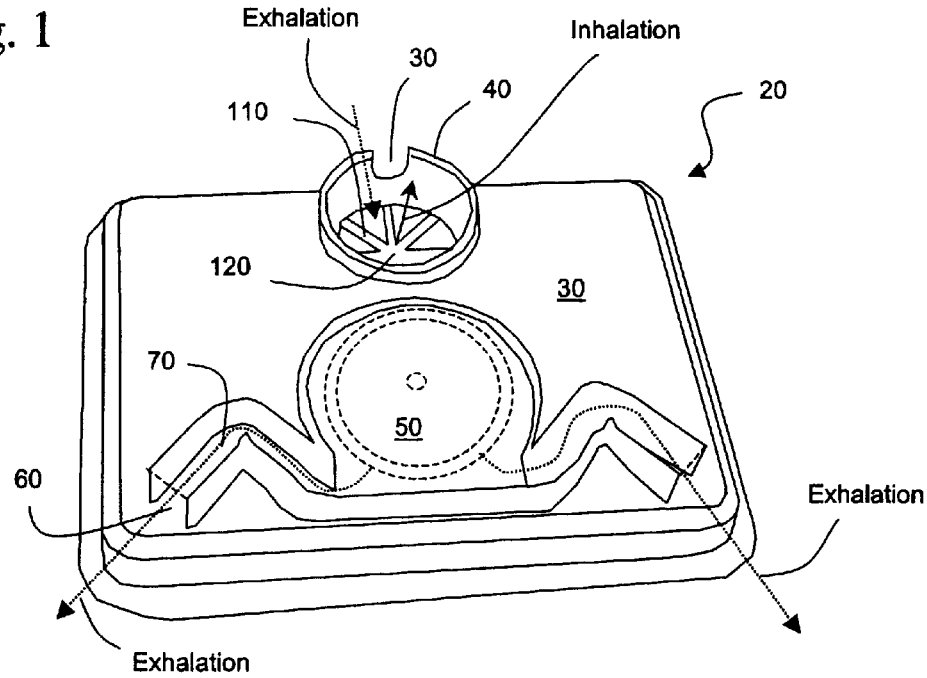
FIG. 1 is a perspective view of the rear side of the filter housing with the check valve cover removed.

Turning to FIG. 1, rear side 30 of filter housing 20 has single fluid conduit 40 and exhalation check valve 50. Exhalation check valve 50 is a resilient elastomeric disc secured to filter housing 20 at the center axis of the disc. Exhalation conduits 60 discharge exhaled air released from check valve 50 passing through external baffles 70. Check valve cover 80 (shown in FIGS. 3, 7 and 8) sealingly covers check valve 50 and external baffles 70 when assembled. Single fluid conduit 40 provides a pathway into oral-nasal cup 90 (FIGS. 3–4, and 12) through hood 100 (FIGS. 5–6 and 14–16). Plurality of support ribs 110 (FIG. 2) radiate from epicenter 120 of single fluid conduit 40. Drink tube slot 130 accommodates drink tube 140 (FIGS. 5–6, 10 and 15–16) which is externally coupled to a fluid source (not shown) while hood 100 is worn. Drink tube 140 is threaded through single fluid conduit 40 and is accessible to the mouth of the wearer in oral-nasal cup 90. Drink tube 140 is preferably flexible to accommodate a folding of the oral-nasal cup but also resilient to return to an accessible position in the cup when the hood is deployed.

Figure 2:
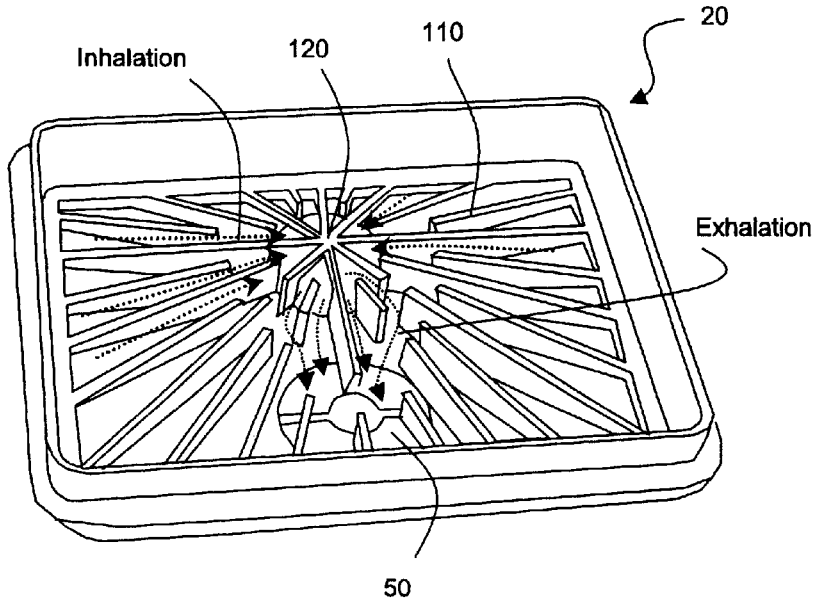
FIG. 2 is a perspective of the interior chamber of the filter housing showing the support ribs radiating from the single conduit.

In FIG. 2, the interior chamber of filter housing 20 is viewable. Filter media 150 (FIG. 7) is laid over plurality of support ribs 110 and front side of filter housing (FIG. 7) engages rear side 30 to hold filter media 150 in place. Rear side 30 of filter housing 20 is preferably arcuate outward from the interior chamber. Exhalation check valve 50 is thereby canted towards single conduit 40 at about eight degrees. The interface between filter media 150 and the plurality of support ribs 110 is planer. Consequently, to accommodate the arcuate shape of rear side 30, support ribs 110 have greater depth around single fluid conduit 40. As exhaled air flows towards exhalation check valve 50, support ribs 110 become more shallow in depth. Check valve 50 opens near external baffles 70 (distal to single conduit 40) which reduces exhalation resistance experienced by the wearer.

Figure 3:
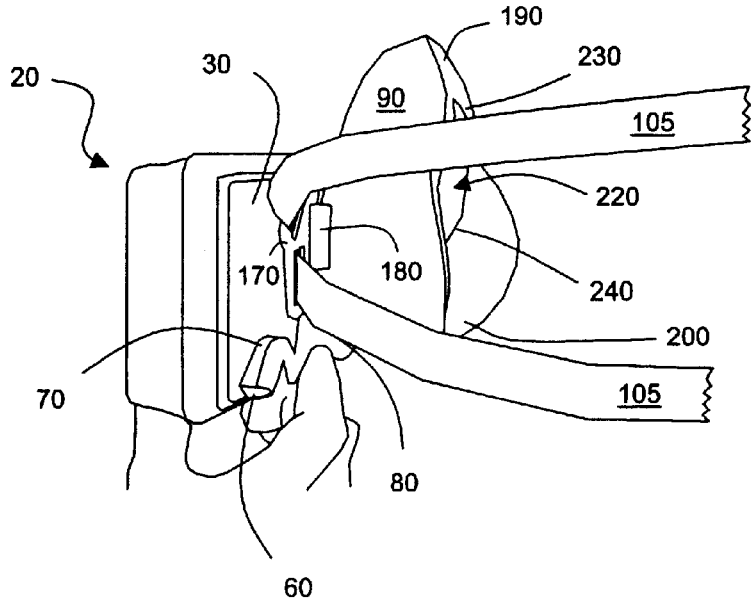
FIG. 3 is an elevated, isometric view of the oral-nasal cup fluidly coupled to the filter housing without the hood installed.

In FIG. 3, filter housing 20 and oral-nasal cup 90 are coupled without hood 100 for illustrative purposes. Tension straps 105 encircle the head of the wearer and are secured at tension strap interface 170 on both sides of oral-nasal cup 90. Pressure distribution bar 180 is secured to filter housing 20. As tension straps 105 pull oral-nasal cup 90 against the face of the wear via tension strap interface 170, pressure distribution bar 180 distributes the force across oral-nasal cup 90 preventing its collapse.

Figure 4:
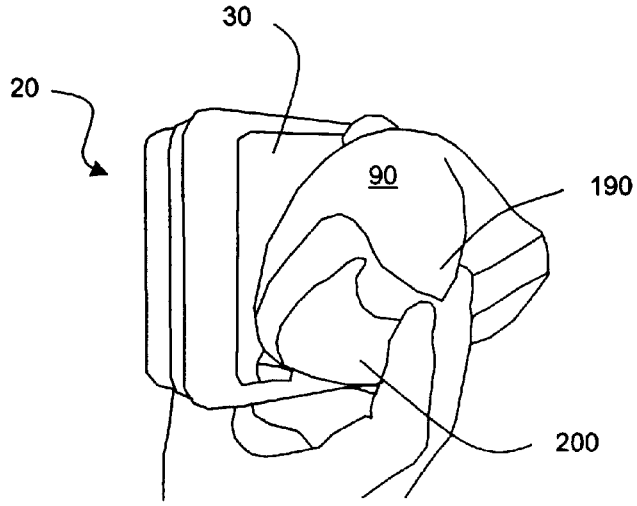
FIG. 4 is an elevated, isometric view of the upper portion of the oral-nasal cup folded down to lay coincident to the lower portion of the oral-nasal cup across a fold line defined by the oral-nasal cup opening.

FIG. 4 illustrates the general folding configuration of oral-nasal cup 90 against filter housing 20. Upper portion 190 of the oral-nasal cup 90 folds over lower portion 200 to reduce the package size of the entire apparatus during storage.

Figure 5:
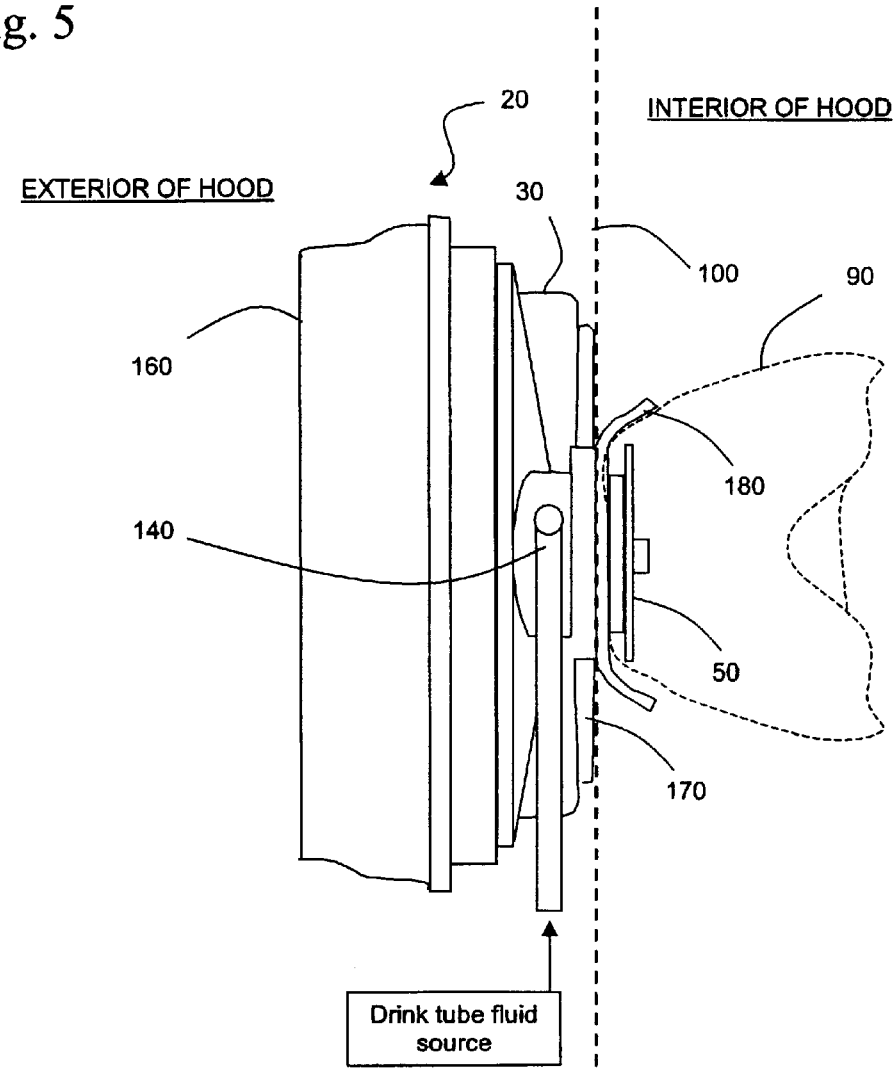
FIG. 5 is top elevated view of the filter housing secured to a cross section of the hood.
Figure 6:
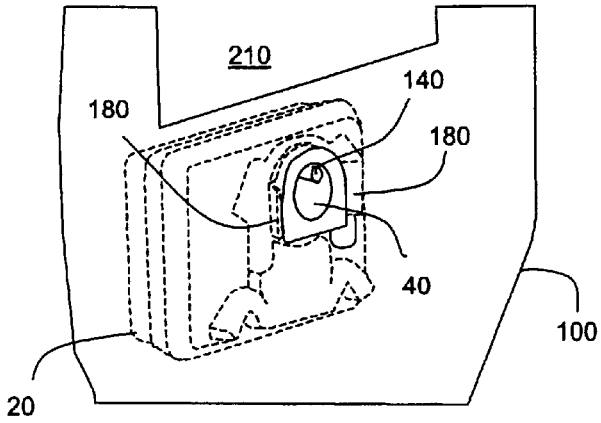
FIG. 6 is an elevated, isometric view of the rear side of the filter housing relative to the position of the hood.

FIG. 5 shows filter housing 20 fluidly connecting through hood 100 to the interior of the hood to be coupled with oral-nasal cup 90. Drink tube 140 is externally accessible for connection to fluids wherein the wearer does not need to remove the hood to access beverages and/or fluid medications. In FIG. 6, the relative position of filter housing 20 is shown in relation to hood 100. Visor 210 is illustrated to identify the ocular area of the wearer beneath which the nose and mouth engage oral-nasal cup 90.

Figure 7:
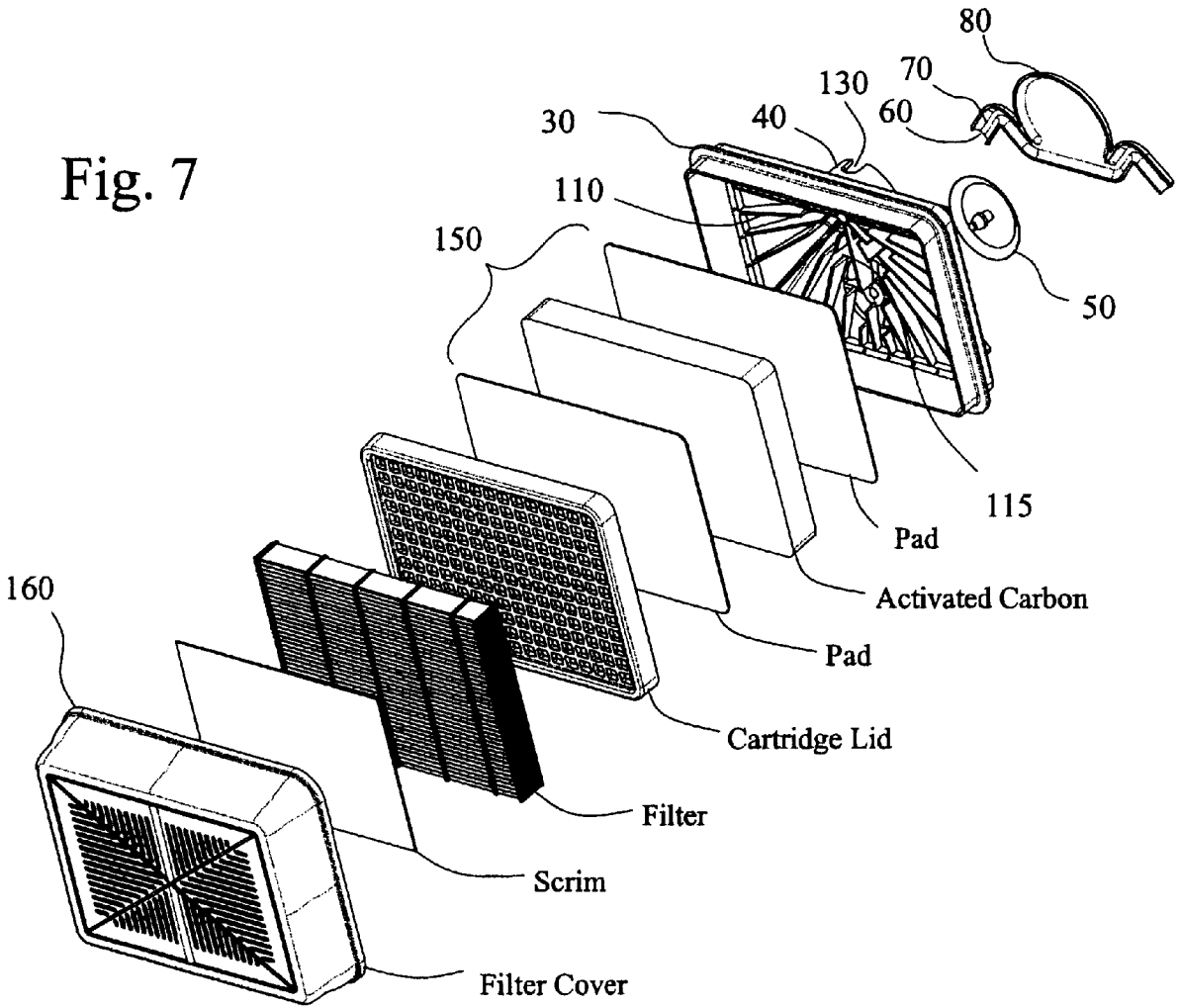
FIG. 7 is an isometric, exploded view of the filter housing components.
Figure 8:
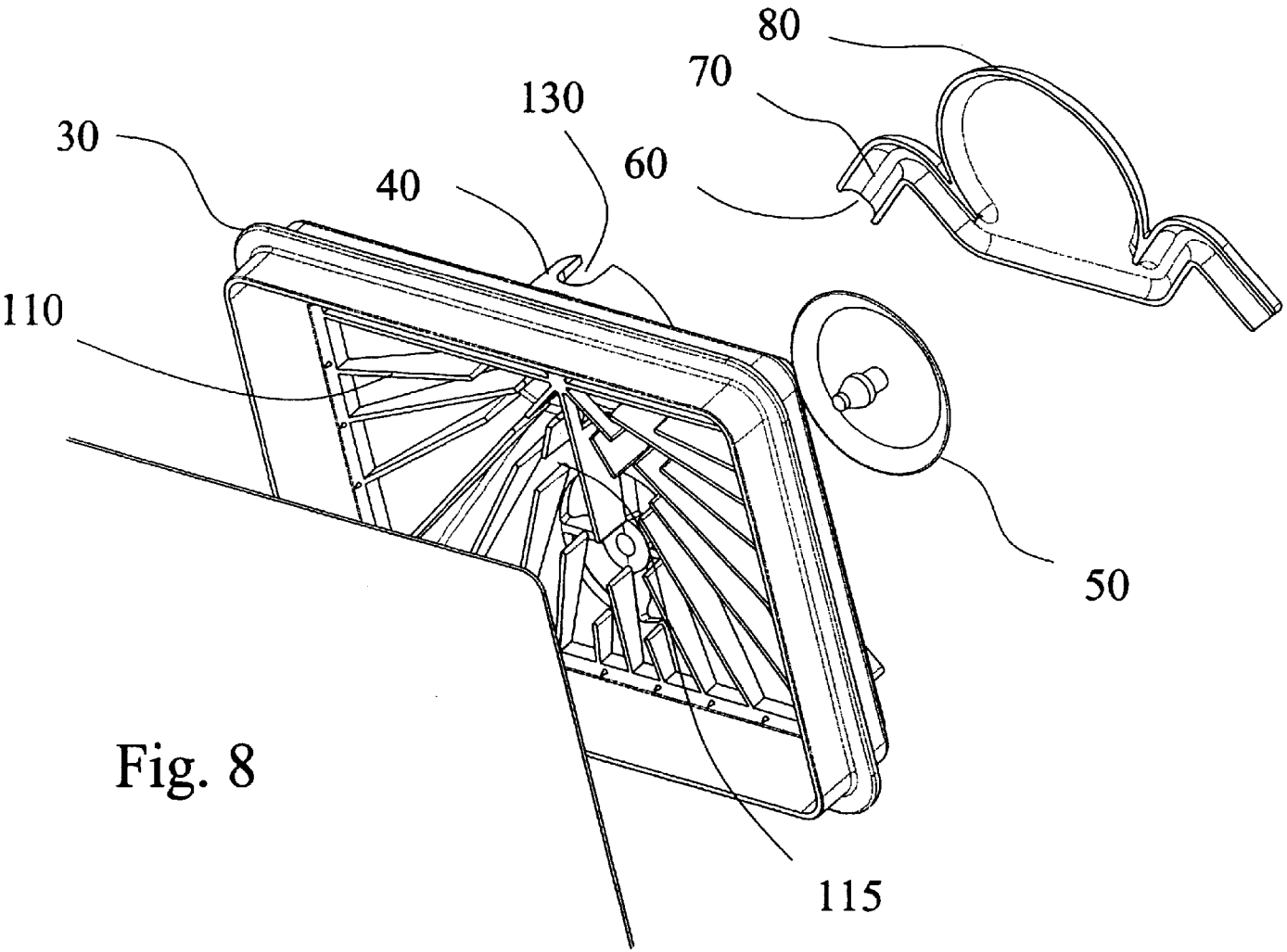
FIG. 8 is an isometric, exploded view of the filter housing components.
Figure 9:
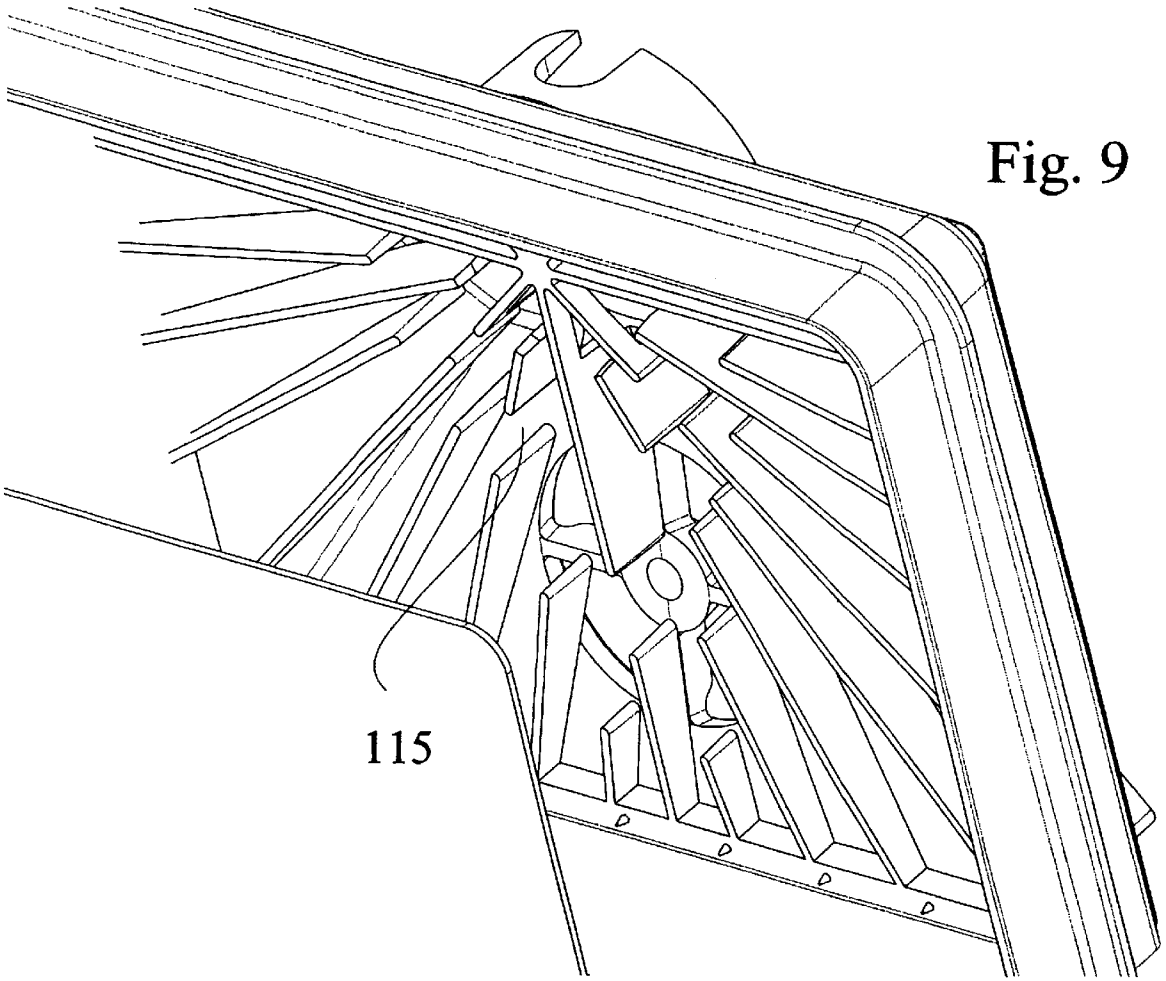
FIG. 9 is an isometric, exploded view of the filter housing components.

FIGS. 7–9 are exploded views of filter housing 20 assembly. Passages 115 are formed in support ribs 110 to provide a path for exhaled air from single conduit 40 to exhalation check valve 50. In FIG. 9, it can be readily seen that without passages 115, only a small portion of exhaled air would make a direct path to exhalation check valve 50. This would lead to a highly increased exhalation resistance.

Figure 10:
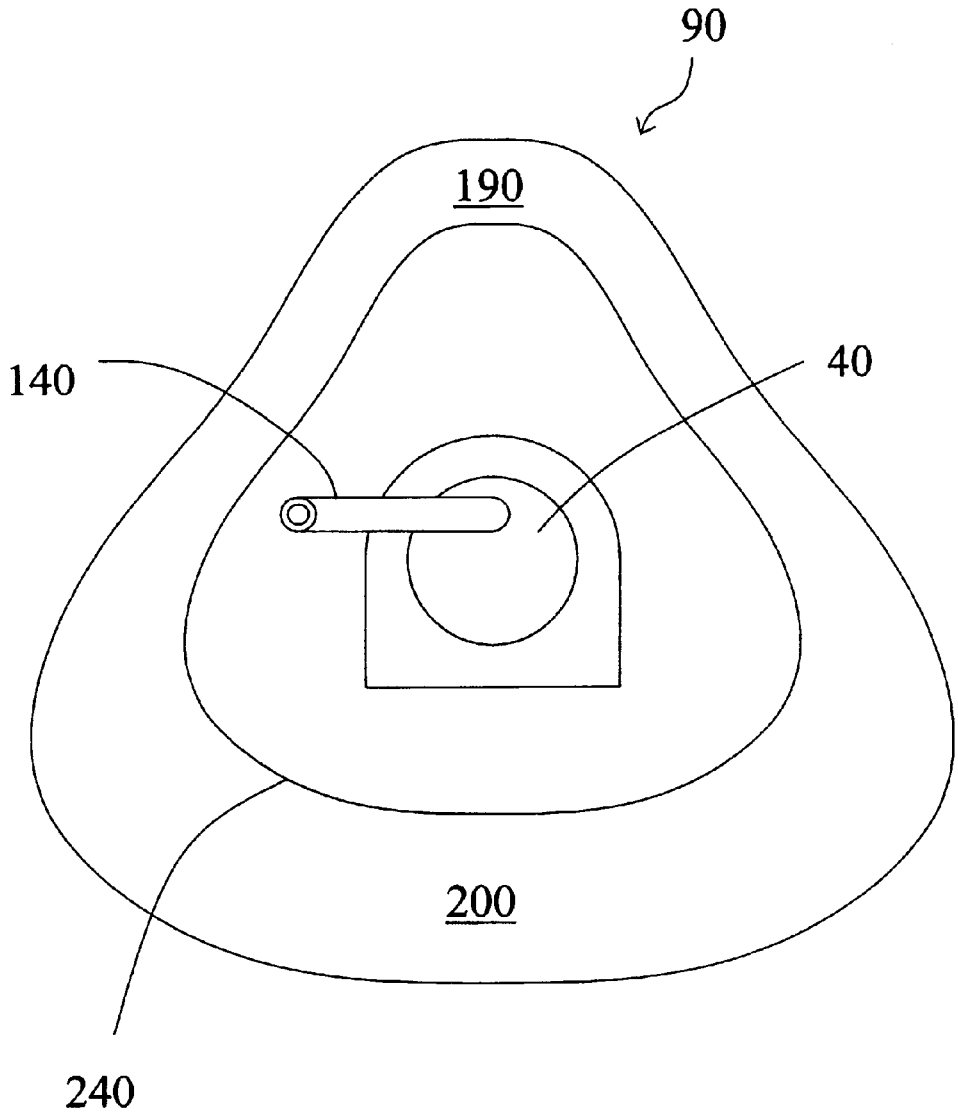
FIG. 10 is an elevated view of the interior of the oral-nasal cup.

FIG. 10 shows oral-nasal cup 90 looking into single conduit 40. Drink tube 140 is preferably offset from the center axis of single conduit 40 wherein drink tube 140 does not interfere with respiration or speech unless drinking is required. Oral-nasal cup 90 has an inwardly disposed lip 240 about the perimeter of the cup opening. Lip 240 provides a surface area that presses against the face of the wearer to form a substantially airtight seal.

Figure 11:
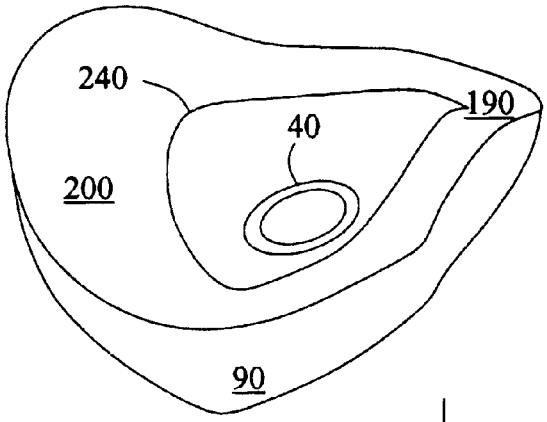
FIG. 11 is an isometric view of the oral-nasal cup prior to folding.
Figure 12:
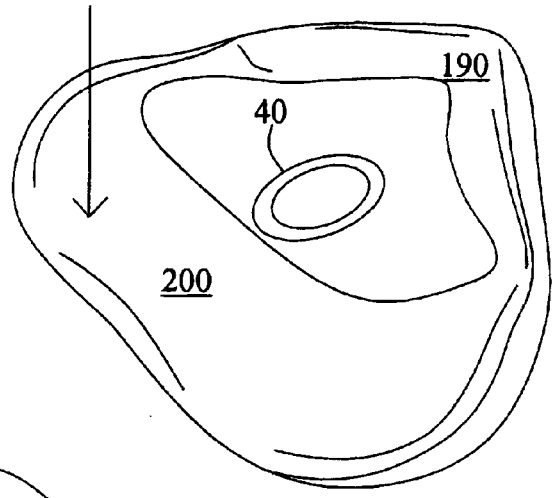
FIG. 12 is an isometric view of the oral-nasal cup with the lower portion of the cup folded down.
Figure 13:
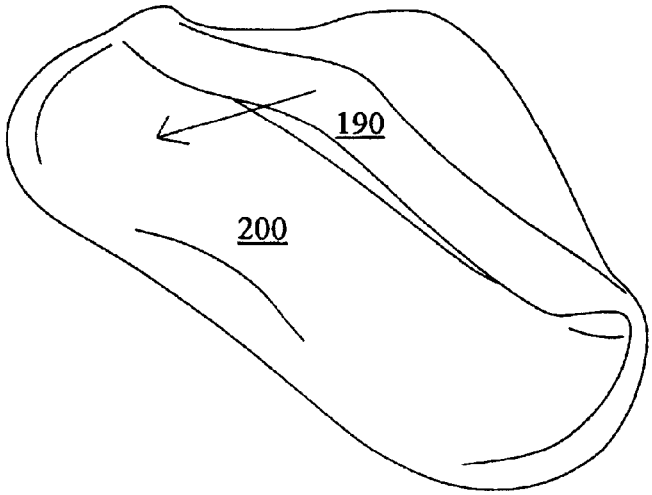
FIG. 13 is an isometric view of the oral-nasal cup with the lip of the upper portion pulled out and folded flat against the lower portion of the cup.

FIGS. 11–13 illustrate the preferred folding of the oral-nasal cup for storage.

The hood, tension straps, drink tube and filter housing are not shown in FIGS. 11–13 for clarity. FIG. 11 shows oral-nasal cup in its normal state. In FIG. 12, lower portion 200 of cup 90 is folded down. In FIG. 13 lip 240 of upper portion 190 is pulled out and laid flat over lower portion 200.

Figure 14:
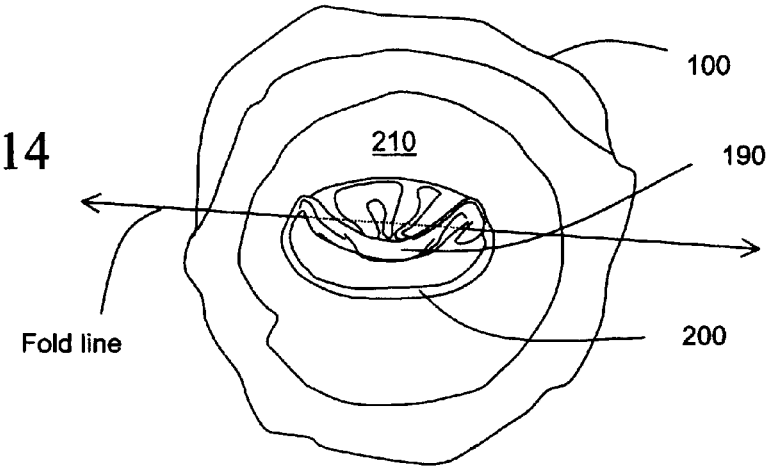
FIG. 14 is an elevated view of the oral-nasal cup in a folded configuration.
Figure 15:
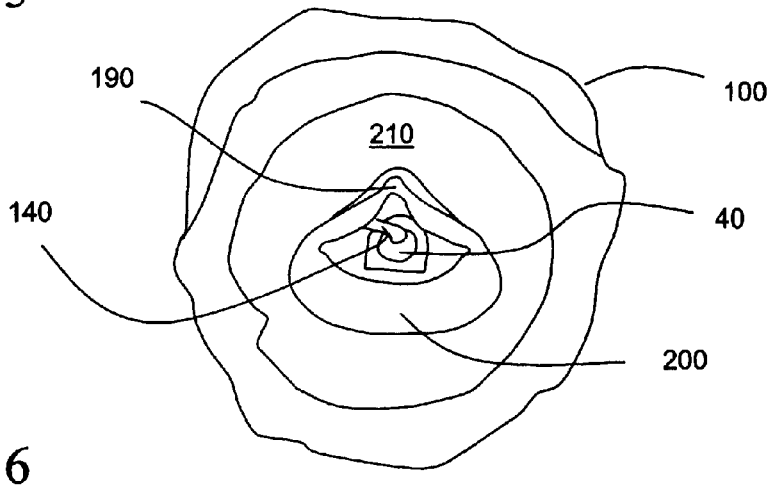
FIG. 15 is an elevated view of the oral-nasal cup in an intermediary unfolded configuration.
Figure 16:
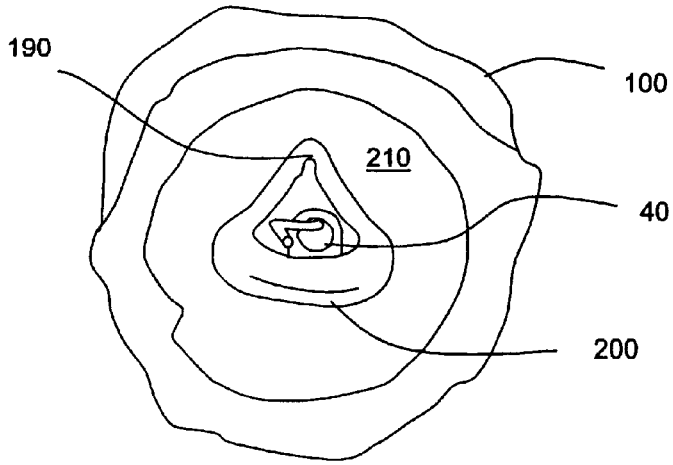
FIG. 16 is an elevated view of the oral-nasal cup fully unfolded.

FIGS. 14–16 illustrate the unfolding of the oral-nasal cup during unpacking for deployment. In a packed configuration, oral-nasal cup 90 is pulled through neck dam 210 in hood 100. In FIG. 14, lip 240 of upper portion 190 is folded flat over lower portion 200. In FIG. 15 upper portion 190 resiliently unfolds while lower portion remains collapsed downward. In FIG. 16, when oral-nasal cup is pushed through neck dam 210 back into the interior of hood 100, lower portion flips up returning the cup to its operational form.

Figure 17:
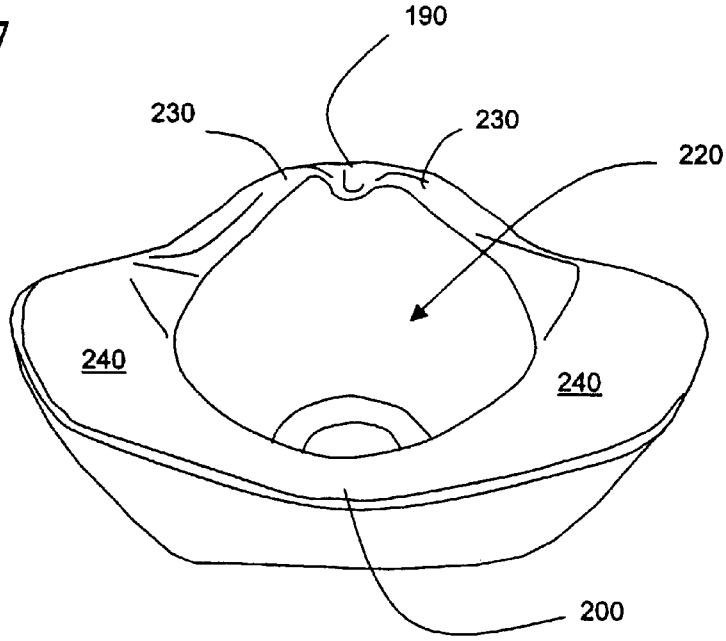
FIG. 17 is an elevated view of the oral-nasal cup after storage in a folded configuration.

FIG. 17 shows the importance of how the oral-nasal cup 90 is folded. Upper portion 190 is folded down against lower portion 200 thereby closing interior cavity 220 wherein respiration occurs. Upper crease convexities 230 on lip 240 are formed by the folding process in upper portion 190 of oral-nasal cup 90, specifically by the pulling flat of lip 240 of upper portion 190. Upper portion 190 engages the nose bridge of the wearer, which is normally a difficult area to seal relative to other facial areas. To those skilled in the art, any creasing of a sealing interface is considered a drawback. Therefore, prior art systems were strongly motivated to avoid creasing at any cost. However, during long term storage, particularly at high temperatures, creasing is virtually inevitable. However, an unexpected and beneficial result of this novel folding process is that upper crease convexities 230 formed in upper portion 190 enhance the face seal on the wearer. Accordingly, it can be seen that the present invention describes what would normally be characterized as a counter-intuitive approach to solving significant problems in the prior art.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A protective hooded respirator comprising: an oral-nasal breathing interface interior to a hood and a mechanical filter housing exterior to the hood, the filter housing further comprising filtration media through which inhaled air is filtered and an exhalation check valve through which exhaled air is discharged, the breathing interface and filter housing fluidly coupled by a single conduit that passes filtered air during inhalation and exhaled air during exhalation.

2. The hood of claim 1 further comprising a drink tube threaded through the single conduit.

3. The hood of claim 1 wherein the exhalation check valve is canted towards the single conduit in a range between zero and ninety-degrees.

4. The hood of claim 1 wherein the exhalation check valve is canted towards the single conduit by approximately eight degrees.

5. The hood of claim 1 wherein the filter housing further comprises:

a front side having at least one or more apertures for receiving unfiltered air;

a rear side having the single conduit fluidly coupled to the breathing interface and the exhalation check valve;

the filter housing interior having filtration media abutting the at least one or more apertures on the front side of the filter housing and an interior chamber coincident to the rear side of the filter housing, the chamber defined by a plurality of support ribs radiating from the single conduit, the support ribs adapted to direct inhaled air to the single conduit and exhaled air from the conduit to the exhalation check valve.

6. The hood of claim 5 wherein the rear side of the filter housing is arcuate outward from the front side of the filter housing.

7. The hood of claim 5 further comprising at least one or more passages formed in the support ribs between the single conduit and the exhalation check valve to permit a flow of exhaled air from the single conduit to the exhalation check valve.

8. The hood of claim 5 further comprising at least one exhalation conduit downstream from the exhalation check valve.

9. The hood of claim 8 further comprising external baffles fluidly coupled to the at least one exhalation conduit, the external baffles inhibiting the backflow of unfiltered air through the exhalation conduit.

10. The hood of claim 9 wherein the external baffles are defined by walls projecting from the rear side of the filter housing, the height of the walls varying in complementary relation to the arcuate slope of the rear side of the filter housing whereby the walls of the external baffles distal to the single conduit are higher than the external baffle walls proximate to the single conduit.

11. The hood of claim 8 wherein the exhalation conduit is positioned proximate to the portion of the exhalation check valve distal from the single conduit.

12. The hood of claim 1 further comprising at least one or more tension straps secured to the filter housing and adapted to bias an oral-nasal cup against the face of the wearer.

13. The hood of claim 12 further comprising a pressure distribution bar secured to the filter housing and biased across a portion of the oral-nasal cup whereby force applied by the tension straps at the filter housing is distributed across the portion of the oral-nasal cup wherein the oral-nasal cup does not collapse against the face of the wearer.

14. A method of folding an oral-nasal cup having an upper portion covering the nose of the wearer when engaged and a contiguous lower portion covering the mouth of the wearer when engaged, an interior cavity wherein respiration occurs, an inwardly disposed lip about the perimeter of the cup and an opening adapted to sealingly engage the wearer's face and an exterior, the method comprising the steps of pulling the lip of the upper portion outward whereby it is fully extended and folding the upper portion and extended lip of the cup to lay flat against the lower portion of the cup across a fold line defined by the cup opening.

15. A method of configuring a respirator hood with an oral-nasal cup for compact storage comprising the steps of:

providing a hood adapted to enclose the head of a wearer, the hood having an interior and an exterior;

providing a neck opening in the hood adapted to seal about the neck of the wearer;

providing a filter housing adapted to filter inhaled air and exhaust exhaled air, the filter housing secured to the exterior of the hood;

providing a flexible, resilient oral-nasal cup secured to the interior of the hood, the cup having an upper portion covering the nose of the wearer when engaged and a contiguous lower portion covering the mouth of the wearer when engaged, an interior cavity wherein respiration occurs, an opening adapted to sealingly engage the wearer's face and an exterior;

providing an inwardly disposed lip about the perimeter of the cup;

fluidly coupling the filter housing to the oral-nasal cup interior cavity through an aperture in the hood;

pulling the lip of the upper portion outward whereby it is fully extended;

folding the upper portion and extended lip of the cup to lay flat against the lower portion of the cup across a fold line defined by the cup opening; and pulling the cup through the neck opening.

* * * * *